US005375518A

United States Patent [19]

Kurz

[11] Patent Number: 5,375,518

[45] Date of Patent: Dec. 27, 1994

[54] SYSTEM FOR KEEPING THE PRINTING PLATES OF A PRINTING PRESS AT A MODERATE TEMPERATURE

[75] Inventor: Hans-Joachim Kurz, Gesserthausen, Germany

[73] Assignee: Baldwin-Gegenheimer GmbH, Augsburg, Germany

[21] Appl. No.: 191,329

[22] Filed: Feb. 3, 1994

Related U.S. Application Data

[63] Continuation of Ser. No. 9,549, Jan. 26, 1993, Pat. No. 5,309,838.

[30] Foreign Application Priority Data

Jan. 30, 1992 [DE] Germany ..... 4202544

[51] Int. Cl.[5] ..... B41F 5/00

[52] U.S. Cl. ..... 101/216; 101/487; 62/64; 165/89

[58] Field of Search ..... 101/487, 350, 352, 416, 101/349, 212, 216, 219, 348, 450.1; 165/89, 30, 32; 62/64

[56] References Cited

U.S. PATENT DOCUMENTS

| | | | |
|---|---|---|---|
| 1,749,316 | 3/1930 | Catlin . | |
| 2,022,635 | 11/1935 | Durham | 101/157 |
| 2,063,636 | 12/1936 | Stevens et al. | 101/147 |
| 2,063,672 | 12/1936 | Goddard | 101/147 |
| 2,319,853 | 5/1943 | Durham | 101/416 |
| 2,651,992 | 9/1953 | Sauberlich | 101/416 |
| 2,884,855 | 5/1959 | Koch | 101/142 |
| 2,971,460 | 2/1961 | Shindle | 101/416 |
| 2,972,301 | 2/1961 | Gessler et al. | 101/426 |
| 3,318,018 | 5/1967 | Steele | 34/62 |
| 3,628,454 | 12/1971 | Eberly, Jr. | 101/147 |
| 3,686,771 | 8/1972 | Schone et al. | 34/44 |
| 3,847,079 | 11/1974 | Dahlgren | 101/426 |
| 4,972,774 | 11/1990 | MacPhee | 101/487 |
| 5,036,761 | 8/1991 | Wingo | 101/148 |
| 5,074,213 | 12/1991 | Kurosawa | 101/487 |
| 5,177,975 | 1/1993 | Mertens | 62/64 |
| 5,178,064 | 1/1993 | Kerber et al. | 101/487 |
| 5,189,960 | 3/1993 | Valentini | 101/487 |

FOREIGN PATENT DOCUMENTS

| | | |
|---|---|---|
| 1953590 | 6/1971 | Germany . |
| 2258640 | 11/1972 | Germany . |
| 3439090 | 1/1987 | Germany . |
| 3541458 | 5/1987 | Germany . |
| 4000912 | 5/1991 | Germany . |
| 56-127457 | 10/1981 | Japan . |
| 56159505 | 4/1983 | Japan . |
| 62228553 | 3/1989 | Japan . |
| 4-14452 | 1/1992 | Japan . |
| 115970 | 5/1918 | United Kingdom . |
| 1534340 | 12/1978 | United Kingdom . |

*Primary Examiner*—Eugene H. Eickholt
*Attorney, Agent, or Firm*—Darby & Darby

[57] ABSTRACT

A system for keeping the surface (4) of a rotating cylindrical printing plate (6) of a printing press at a moderate temperature. A cooling air blower girder (2) extends longitudinally over the printing plate surface (4) and blows cold air onto the printing plate surface (4), in order to keep its temperature at a desired value. The blast-air girder (2) contains at least one heat exchanger (52) and at least one blower (60) as well as at least one air-return duct (20, 22), which together forms a cooling air cycle, through which the air, blown onto the printing plate surface (4), is returned to the air inlet of the heat exchanger and, optionally mixed with fresh air, blown by the blower (60) once again through the heat exchanger (52) onto the printing plate surface (4). The blast-air girder (2) represents an energy-saving, compact structural unit for keeping the printing plate surface (4) at a moderate temperature.

5 Claims, 3 Drawing Sheets

SYSTEM FOR KEEPING THE PRINTING PLATES OF A PRINTING PRESS AT A MODERATE TEMPERATURE

This is a continuation of application Ser. No. 08/009,549, filed Jan. 26, 1993, now U.S. Pat. No. 5,309,838.

FIELD OF THE INVENTION

The invention relates to a system for keeping the printing plates of a printing press at a moderate temperature.

BACKGROUND OF THE INVENTION

The inventor has already carded out attempts with blast-air cooling equipment, which has a heat exchanger, through which a cooling liquid flows. The equipment also has an air inlet, an air outlet and a blower, which drives air from the air inlet to the air outlet through the heat exchanger and from the air outlet side onto the surface of a rotating, cylindrical printing plate. With this air, the surface of the cylindrical printing plate may be maintained at a temperature between 24° and 27° C.

It is an object of the invention to drastically reduce the energy required to operate the blast-air cooling equipment. A further object of the invention consists of integrating the blast-air cooling equipment into a printing system for keeping the printing plates at a moderate temperature so that the cooling equipment may be incorporated into a variety of printing systems. The cooling equipment could be, for example, blast-air cooling equipment (waterless offset printing); inkers, so-called ink rollers, through which a cooling liquid flows (waterless offset printing); or with a damping liquid, which is applied on the surface of the printing plate (damping mixture offset printing). For each of these three different modes of operation, the energy required for the operation is reduced. Another object of the invention is constructing a system for maintaining a moderate temperature such that it can be produced inexpensively. It is furthermore an object of the invention to construct the system for keeping the printing plates at a moderate temperature so that it can be converted in a short time and without extensive structural measures from one mode of operation to another mode of operation. This mode switching preferably shall be possible simply by switching valves, without having to dismantle or modify machine pans.

This objective is accomplished pursuant to the invention by the distinguishing features of claim 1.

SUMMARY OF THE INVENTION

In particular, the invention relates in one embodiment to waterless, continuous offset printing and also makes it possible that printing can be carded out alternatively by a continuous damping mixture offset method of printing using the same printing unit of a printing press.

For waterless, continuous offset printing with so-called "TORAY" printing plates, it is necessary to limit the temperature of the cylindrical, rotating printing plate surface to 24° to 27° C. For this purpose, the printing plate surface is cooled pursuant to the invention with cold air.

Pursuant to the invention, a system was created for keeping the printing plates at a moderate temperature not only with the waterless offset printing method, but also with the known damping mixture offset printing method. This system can be mass produced and can be used with both modes of operation, "waterless offset printing" and "damping mixture offset printing."

Pursuant to the invention, a microcomputer is provided in which steady state control characteristics for all modes of operation of the system for keeping printing plates at a moderate temperature are stored. The microcomputer also contains all desired operating values and receives all actual values, which are to be monitored for the operation. For waterless offset printing, water, which can be mixed with additives, is used as a cooling liquid. This water is referred to in the following description as "cold water". It is prepared and stored in a first storage tank. In a second storage tank, which is separate from the first storage tank, the "damping mixture" is prepared and stored for use in damping mixture offset printing. The damping mixture as well as the cold water are cooled by a cooling plant, which is common to both of them. As a result, the installation as a whole is compact and inexpensive and enables any one of the three possible modes of operation to be used alternatively with little need for energy: 1. waterless offset printing with blast-air cooling by the blast-air cooling equipment; 2. waterless offset printing by cooling ink rollers of a printing unit with the same cold water, with which the cold air is cooled in the blast-air cooling equipment; 3. damping mixture offset printing by moistening the surface of the printing plates with the damping mixture.

BRIEF DESCRIPTION OF THE DRAWINGS

The invention is described in the following with reference to the drawings by means of a preferred embodiment as example. In the drawings.

DETAILED DESCRIPTION OF THE PREFERRED EMBODIMENTS

Figure 1:
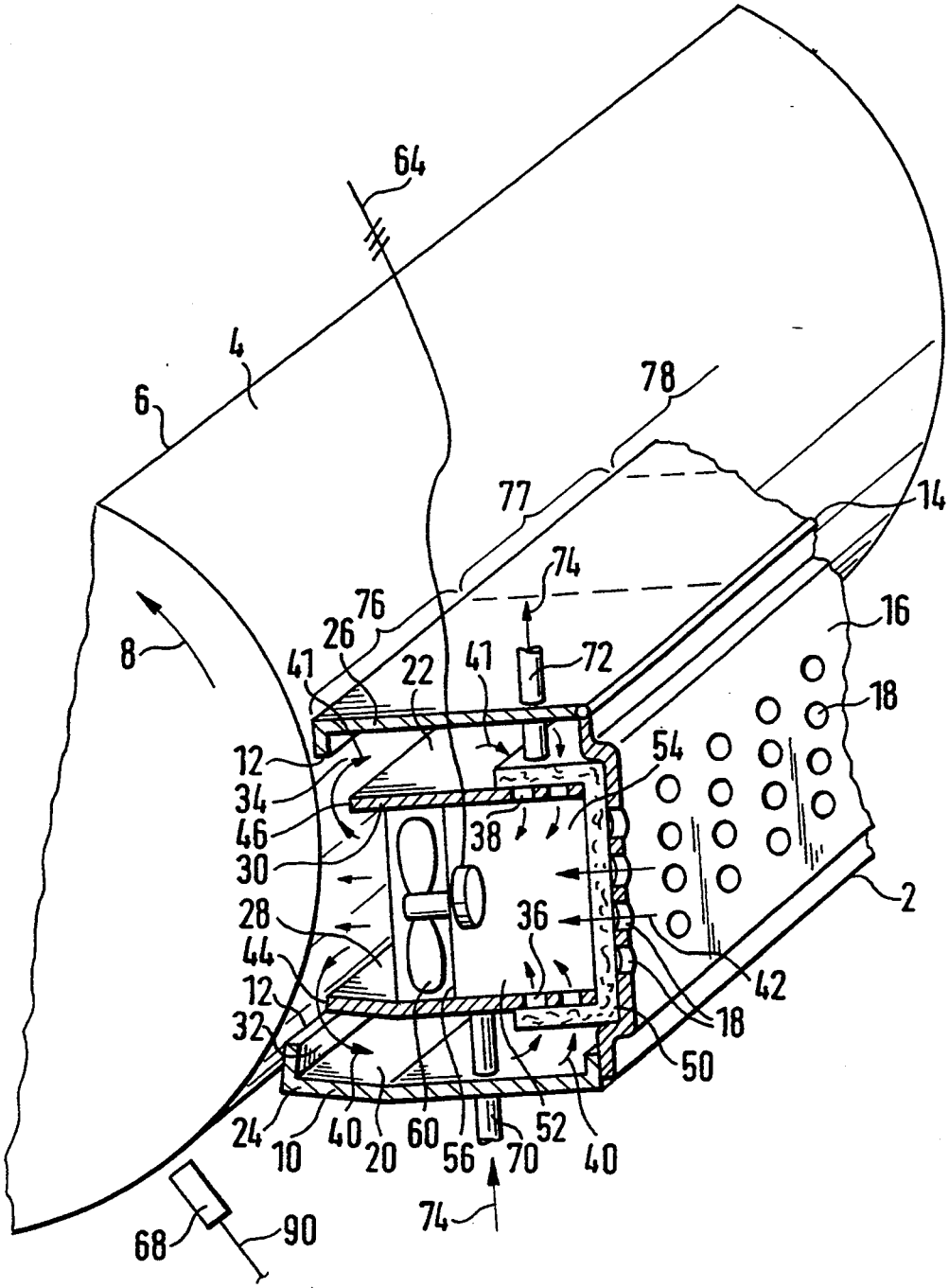
FIG. 1 shows a truncated perspective view of blast-air cooling equipment in the form of a girder-like, elongated structural unit that blows cool air against the surface of a rotating, cylindrical printing plate.

FIG. 1 shows a truncated, perspective representation of blast-air cooling equipment 2, which is a girder-like, elongated structural unit. This structural unit or blast-air cooling equipment 2 extends at a distance from and essentially over the whole axial length of a cylindrical surface 4 of a cylindrical printing plate 6, which rotates in the direction of arrow 8. The blast-air cooling equipment 2 is stationary relative to the rotating printing plate 6. The blast-air cooling equipment 2 consists of a housing 10, which is open on its side facing the surface 4 of the printing plate, and thereby forms an air outlet 12, which extends over the whole length of the roller.

On the side of the housing facing away from the air outlet 12, is a cover 16, which can be swivelled about a hinge 14 and in which a plurality of boreholes 18 are formed as air inlets for air outside of the housing 10. Air return ducts 20 and 22 are formed between a lower metal housing sheet 24 and an upper metal housing sheet 26 and a lower guide plate 28 and an upper guide plate 30 disposed at a distance from said metal housing sheets. Each of the ducts 20,22 forms a return air inlet 32 and 34 on the side of the blast-air cooling equipment 2 opposite to the printing plate surface 4 and has, on the same side of the blast-air cooling equipment 2, air return outlets 36 and 38. Return air 40 and 41 flows over the outlets 36,38 and is carried away from the printing plate surface 4, flows together and is mixed with fresh air 42, and then flows over the air inlet 18 in the cover 16 into the blast-air cooling equipment 2. The opening edges 44 and 46 of the guide plates 28 and 30, which form the return air inlets 32 and 34 together with the opening edges of the air outlet 12, are further removed radially from the printing plate 4 than are the edges of the air outlet 12 of the housing 10.

There is an air filter 50 behind the cover 16 that extends over the air inlet 18 and the return air outlets 36 and 38 and filters the air. There is a heat exchanger 52 behind the air filter 50 and between the guide plates 28 and 30 that extends essentially over the whole axial length of the printing plate surface 4. On its side facing away from the printing plate surface 4, the air inlet 18 and the return air outlets 36 and 38 form a heat-exchanger air inlet 54. The side of the heat exchanger 52 facing the printing plate surface 4 forms a heat exchanger air outlet 56.

There is at least one, but preferably a plurality of blowers 60 at the heat exchanger air outlet 56, between the heat exchanger 52 and the printing plate 6, and between the two guide plate 28 and 30. The blowers 60 are disposed next to one another over the axial length of the cylindrical printing plate 6 and over the length of the blast-air cooling equipment 2. At the heat exchanger air inlet 54, the blowers 60 aspirate fresh air 42 through the air inlet 18 and return air 40 and 41 through the return air outlets 36 and 38. The blowers 60 also aspirate the fresh air 42 and return air 40 and 41, which mix with one another, through the heat exchanger 52, in which the mixed air is cooled, and blow this mixture onto the cylindrical surface 4 of the cylindrical printing plate 6. The surface 4 guides the air tangentially in the direction of rotation 8 and also in the opposite direction into the return air inlets 32 and 34. This return air 40 and 41 flows through the air return ducts 20 and 22 over the return air outlets 36 and 38 and back to the heat exchanger air inlet 54. This flow forms an air recirculation cycle into which fresh air 42 is added by the suction action of the blower 60, but only enough to compensate for air that has escaped into the surroundings at the air outlet 12 between the housing 10 and the surface 4 of the printing plate 6. As a result, there is a significant savings in energy compared to a device that does not have a recirculation cycle through return air ducts 20 and 22 and works only with fresh air. The blowers 60 contain an electric motor that drives their fans. The rotational speed of the motor is regulated by the electrical lines 64 from electronic control equipment 66, which contains a microcomputer, as a function of a desired temperature value of the printing plate surface 4 and the respective actual temperature value of this printing plate surface 4. The actual temperature value of the printing plate surface 4 is measured by sensors 68, which preferably are infrared sensors. If the actual temperature value is higher than the desired temperature value, the rotational speed of the fans of blowers 60 is automatically increased by the microcomputer of the control equipment 66, in order to increase the cooling effect on the printing plate surface 4. If the actual temperature value of the printing plate surface 4 falls below the desired temperature value, the rotational speed of the fans of blowers 60 is correspondingly lowered by the microcomputer. Cold water is preferably used as a cooling liquid for cooling the heat exchanger 52, which is preferably a plate heat exchanger. The cold water flows through the heat exchanger from a cold water inlet 70 to a cold water outlet 72 in the direction of arrows 74. The heat exchanger 52 is a component of a cooling liquid cycle, in which the cold water, heated by the heat exchanger 52, is constantly cooled before it is returned once again to the heat exchanger 52. Thus, it is possible to change the temperature of the air blown by the blowers 60 onto the printing plate surface 4 by changing the temperature of the cold water of the heat exchanger 52. It is also possible to affect the temperature of the printing plate surface 4 by varying the rotational speed of the blowers 60 and/or by varying the temperature of the cold water, which is supplied to the heat exchanger 52.

Due to the use of several blowers 60 instead of only a single one, the blast-air cooling equipment 2 has a number of cooling air sections 76, 77, 78 etc. corresponding to the number of blowers 60 distributed over the axial length of the printing plate surface. By driving the blowers 60 separately, the printing plate surface 4 can be cooled to different degrees in different sections along its axially length corresponding to the cooling air sections 76, 77, 78, etc. Instead of a single heat exchanger 52, which extends over the suction sides of all blowers 60, each blower 60 can have its own heat exchanger 52, which is regulated individually with respect to the cold water temperature. By these means, the temperature of the printing plate surface can also be set and controlled in each cooling section 76, 77, 78 separately by the appropriate cooling water temperature of the heat exchanger 52. With this, the temperature of the printing plate surface 4 can be regulated in a manner optimum for the printing process not only as a whole, but also selectively in desired zones corresponding to the cooling air sections 76, 77, 78.

Figure 2:
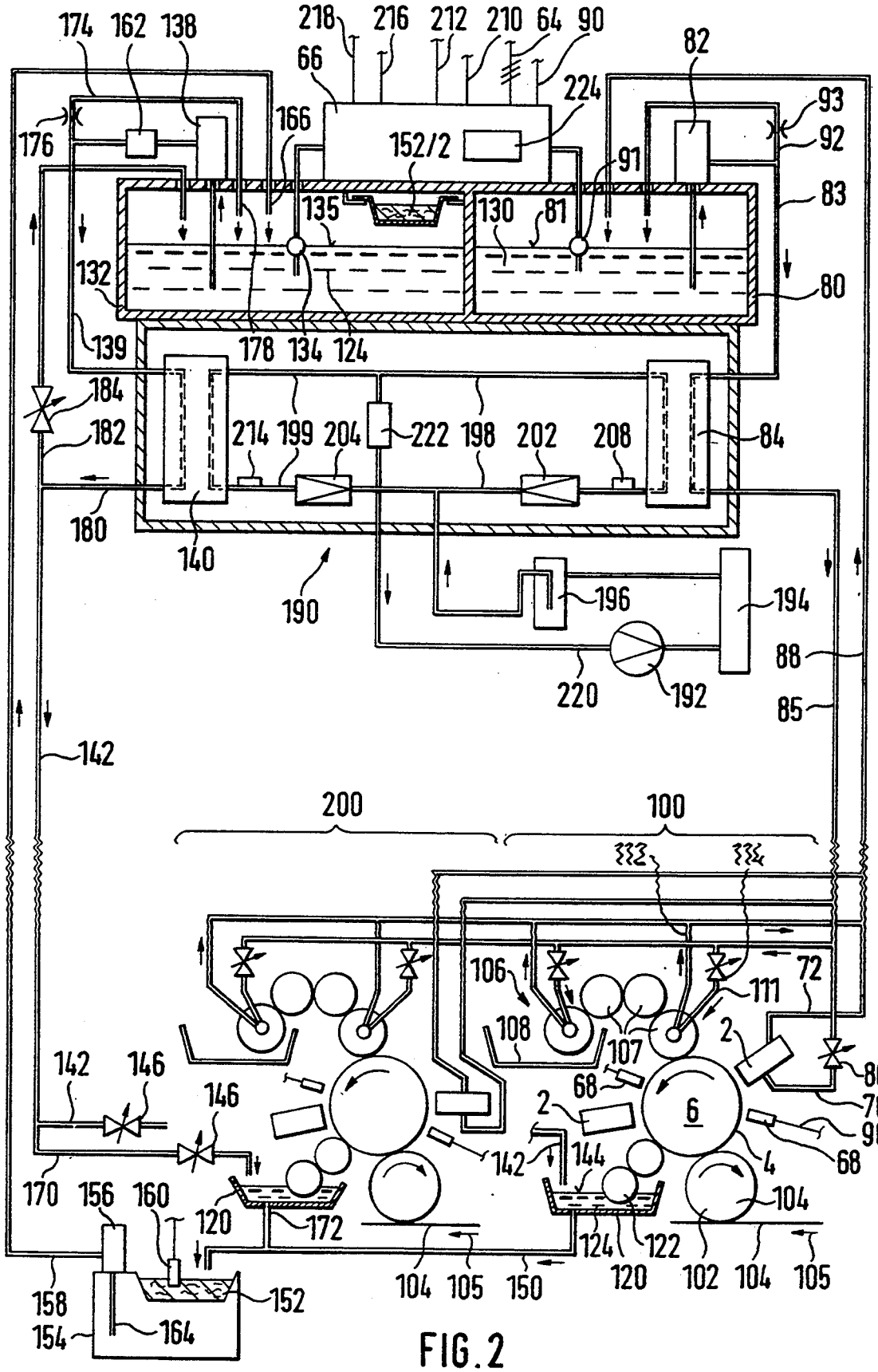
FIG. 2 shows a diagrammatic representation of an inventive system for keeping the printing plates of a printing press at a moderate temperature; the printing press contains, for example, two printing units, which can be operated alternatively with the same mode of printing or each with a different mode of printing, namely waterless offset printing or damping mixture offset printing.

FIG. 2 shows a complete inventive system for keeping the printing plates of a printing press at a moderate temperature. Among other things, the blast-air cooling equipment 2, its cold water inlet 70 and cold water outlet 72, as well as the bundle of electrical lines 64 of the electric motors of the blowers 60 and the microcomputer controlled equipment 66, which regulates the whole of the temperature-controlling system, are shown in FIG. 2.

The cold water for the heat exchanger 52, which serves as cooling liquid, is stored in a first storage tank 80 and provided with additives if necessary. The cold water is maintained at a particular level 81 and fed by a pump 82 through a pipeline 83, a second heat exchanger 84, a pipeline 85 with a valve 86, which can be controlled by the microcomputer of the controlled equipment 66, and through the cold water inlet 70 to the first heat exchanger 52 of the blast-air cooling equipment 2. In the first heat exchanger 52 of the blast-air cooling equipment 2, the cold water removes heat from the fresh air 42 and the recirculated return air 40 and 41. The cold water, so heated, flows through the heat exchanger 52 and over the cold water outlet 72 of said heat exchanger 52 and a cold water return line 88 back into the first storage tank 80. The quicker the cold water flows through the first heat exchanger 52 of the blast-air cooling equipment 2, the stronger the cooling effect on the air 42, 40, 41 in the first heat exchanger 52. The sensor 68, which measures the temperature of the surface 4 is connected over electrical lines 90 with the microcomputer control equipment 66 and indicates to said microcomputer control equipment 66 the respective actual temperature of the printing plate surface 4. The first pump 82 is also connected by electrical lines (not shown) with the microcomputer control equipment 66. By these means, the microcomputer control equipment 66 can regulate the rotational speed of the pump 82 and, with that, the flow rate of the cold water flowing through the first heat exchanger 52 as a function of the desired temperature value stored in the microcomputer control equipment 66 and as a function of the actual temperature value measured by the sensor 68. Thus, the air 40, 41, 42 blown by the blast-air cooling equipment 2 onto the printing plate surface 4, maintains the printing plate surface 4 at the desired temperature value. The temperature can be controlled in this way in addition to or instead of controlling it by altering the rotational speed of the blowers 60.

The blast-air cooling equipment 2 is particularly effective if the edges of the air outlet 12 of the housing 10 lie air-tight against the printing plate surface 4, because air cannot then escape from the blast-air cooling equipment 2 between the housing 10 and the printing plate surface 4. In practice, however, such a tight contact is not possible. It is sufficient if the distance between the edges of the air outlet 12 of the housing 10 and the printing plate surface 4 is very small. Due to the fact that the edges 44 and 46 of the guide plates 28 and 30 are at a greater distance from the printing plate surface 4 than the edges of the air outlet 12, the flow resistance for the air into the air return ducts 20 and 22 is several times less than the flow resistance between the edges of the air outlet 12 of the housing 10 and the printing plate surface 4.

As shown in FIG. 2, the blast-air cooling equipment 2 can also be disposed on a diametrically opposite side of the cylindrical printing plate 6 or several blast-air cooling systems 2 and several temperature sensors 68 can be distributed over the surface 4 of the printing plate 6.

A level sensor 91 in the first storage tank 80 indicates the cold water level 81 to the microcomputer of the control equipment 66. The microcomputer generates a signal when the cold water level 81 in the first storage tank 80 is too low or too high, so that the cold water level 81 can be kept constant automatically or manually. On the pressure side of the pump 82, a venting line 92 with a flow regulating valve 93 leads from the cold water line 83 back into the first storage tank 80. When the pump 82 is switched off, the venting line 92 prevents the aspiration of cold water by capillary action or the action of gravity from the first storage tank 80 into the blast-air cooling equipment 2.

According to FIG. 2, the printing plate 6 is a component of a printing unit 100 of a printing press. The printing unit 100 contains a blanket roller 102, which transfers the printed image from the surface 4 of the printing plate 6 to the printing carrier 104, which is rolling in the direction of an arrow 105 over the cylindrical surface of the blanket roller 102. The surface of the so-called blanket roller 102 can consist of rubber or of a different material. A color printing unit 106 transfers printing ink by means of rollers 107, so-called ink rollers, from an ink reservoir, a so-called ductor roller 108 onto the surface 4 of the printing plate 6. The cold water of the first storage tank 80 can be passed through the ink rollers 107 in order to cool the cylindrical surfaces of the ink rollers 107 and, with that, also the printing ink and the surface 4 of the printing plate 6. The surface 4 of the printing plate 6 can thus be cooled alternatively by air 40, 41, 42 of the blast-air cooling equipment 2 and/or by the cold-water cooling system of the ink rollers 107 and, with that, kept at a desired temperature. The water-cooled ink rollers 107 can be supplied with cold water from the first storage tank 80, since they are connected to the cold water supply line 85 and the cold water return line 88 through flow pipes 111 and return pipes 112. In the flow pipes 111, there is preferably a valve 114, which is opened or closed by the microcomputer control equipment 66 as a function of the desired and actual temperature values. The actual temperature value can be the temperature of the surface 4 of the printing plate 6, measured by the infrared sensor 68. For both types of cooling (blast-air cooling equipment 2 and cooling the ink rollers 107), no cooling liquid is applied on the printing plate surface 4, so that this type of printing can also be referred to as "waterless offset printing". With the same printing unit 100, however, it is also possible to print by the "damping mixture offset printing method" if an additional tub 120 is provided from which a rotating roller 122, dipping into the damping mixture 124, takes up damping mixture 124 and transfers it directly or over further rollers to the surface 4 of the rotating printing plate 6. Thus, it is possible to use the same printing unit 100 to print alternatively by three different methods: 1. damping mixture offset, 2. waterless offset printing with cooling of the printing plate surface 4 by cooling the ink rollers 107, and/or 3. waterless offset printing with cooling the surface 4 of the printing roller 6 by means of the blast-air cooling equipment 2. As shown in FIG. 2, the printing press can have several printing units 100, 200, etc., which can all have the same construction or be different. All printing units 100, 200, etc. can be constructed for one or several of the aforementioned three types of printing. With the present invention, it is possible that the printing carrier 104 can be printed in several printing units by any one of the three different types named. Better printing qualities and new variations in the printed image are also achieved with less consumption of energy and material than previously known. The blast-air cooling equipment 2 can also be retrofitted into any known printing unit.

The damping mixture 124 is stored in a second storage tank 132, which is hermetically separated from the cold water 130 from the first storage tank 80, in which it is kept at an essentially constant level 135 by a level sensor or level switch 134, and in which it can be mixed with additives, such as alcohol. The switch 134 is connected to the microcomputer control equipment 66. To compensate for water losses, the first storage tank 80 as well as the second storage tank 132 have their own water supply, which is not shown, and which is controlled by the microcomputer control equipment 66 as a function of the actual level 81 or 135, which is measured by the level sensor 91 or 134. A second pump 138 pumps damping mixture 124 from the second storage tank 132 over a pipeline 139 through a third heat exchanger 140 and, after the heat exchanger, through a damping mixture flow line 142 into the damping mixture tub 120. The damping mixture 124 is kept constant at a particular liquid level 144 in the damping mixture tub 120. This can be achieved by a damping mixture overflow. The damping mixture passes from the damping mixture tub 120 over the damping mixture overflow due to the action of gravity through a drain 150 and a filter 152 into a filter tank 154. A third pump 156 pumps the purified damping mixture from the filter tank 154 over a return line 158 back into the second storage tank 132. A filter sensor 160 generates a signal when the filter 152 is so highly contaminated that it must be exchanged. There is an alcohol sensor 162 on the pressure side of the second pump 138 in the pipeline 139 that serves to keep the alcohol content of the damping mixture in the second storage tank 132 automatically constant by means of the microcomputer control equipment 66 or to generate an alarm signal when the alcohol content deviates from a desired value. According to a modified embodiment, the drain 150 can be connected directly with the suction side 164 of the third pump 156, the filter 152 can be exchangeably disposed in or on the second tank 132 corresponding to the reference number 152/2 there, and the outlet end 166 can be directed to the filter disposed in the storage tank 132, so that the returned damping mixture is pumped by the third pump 156 to a level above the filter 152/2 and then percolates due to the action of gravity through this filter 152/2 into the second storage tank 132. If several printing units 100, 200, etc. are provided, a branch line 170 from the damping mixture flow line 142 can flow in each case into the damping mixture tub 120 of the additional printing unit 200 etc. The damping mixture tubs 120 of the further printing units are connected in the same manner as the printing unit 100, i.e., first over a branch drain 172 to the drain 150 or, in another embodiment, directly to the suction side 164 of the third pump 156.

On the pressure side of the second pump 138, downstream from the alcohol sensor 162, a venting line 174 with a flow control valve 176, the outlet 178 of which discharges into the second storage tank 132, is connected to the line 139. The venting line 174 prevents aspiration of damping mixture from the second storage tank 132 into the damping mixture tub 120 due to the action of a reduced pressure (suction action), which is produced by the draining damping mixture when the pump 138 is switched off. From the damping mixture outlet 180 of the third heat exchanger 140, to which the damping mixture flow line 143 is also connected, a bypass line 182 with an adjustable valve 184 leads back into the second storage tank 132. The bypass line 182 enables the second pump 138 to run constantly for continuous operation and to cycle the damping mixture when damping mixture cannot be supplied to the damping mixture tub 120, for example, during interruptions to the operation or when the damping mixture level in the damping mixture tank 120 is above the desired value. The damping mixture cycle is formed by the second storage tank 132, the second pump 138, the pipeline 139, the third heat exchanger 140 and the bypass line 182. The damping liquid cycle is formed by the second storage tank 132, the second pump 138, the third heat exchanger 140, the damping mixture flow line 142, the damping mixture tub 120, the drain 150, the filter 152, the third pump 156 and the damping mixture return line 158. Pursuant to a preferred embodiment, the second heat exchanger 84 and the third heat exchanger 140 are components of a cooling installation 190, in which, for the removal of heat, cooling agent in a cooling agent cycle alternately is compressed from the gaseous state into a liquid state and subsequently expanded once again into the gaseous state. A particular feature of this cooling installation 190 is that it has only a single cooling agent cycle with a cooling agent compressor 192, preferably a piston compressor, an air-cooled condenser 194 and a cooling agent collector 196, as well as two cooling agent branches 198 and 199, which are connected parallel to one another. The one cooling agent branch 198 contains its own cooling agent expansion valve 202, which can be adjusted manually or automatically by the microcomputer control equipment 66 and leads through the second heat exchanger 84, in which the cooling agent of this branch cools the cold water, which is passed through the cold water flow lines 83 and 85 through the second heat exchanger 84. The other parallel branch 199 for the cooling agent also contains its own cooling agent expansion valve 204, which can be adjusted manually or automatically by the microcomputer control equipment 66 and leads through the third heat exchanger 140, in which the cooling agent of this parallel branch 199 cools the damping mixture 124, which is then passed through the flow lines 139 and 142 through this third heat exchanger 140. A desired temperature value is stored in the microcomputer for each parallel branch 198, 199 of the cooling agent. In a parallel branch 198 of the cooling agent, there is a temperature sensor 208, which supplies to the microcomputer over electrical lines 210 the actual temperature values, which the microcomputer requires for regulating the cooling agent expansion valve 202 through electrical lines 212. In the other parallel branch 199 of the cooling agent, there is also a temperature sensor 214, which supplies to the microcomputer 66 the actual temperature values of this parallel branch 199 over electrical line 216, as a function of which the microcomputer control equipment 66 controls the cooling agent expansion valve 204 of the second parallel branch 199 of the cooling agent over electrical lines 218, in accordance with the specified, desired temperature. In series between the two parallel branches 198 and 199 and the suction side 220 of the cooling agent compressor 192, there is an evaporation pressure controller 222, which can be adjusted manually or controlled by the microcomputer control equipment 66. The use of a single cooling agent cycle jointly for the cold water 130 of the first storage tank 80 and for the damping mixture 124 of the second storage tank 132 results in considerable savings of material and an energy expenditure for the operation of the system as a whole, which is significantly less than that of known installations. The whole system for keeping the printing plates at a moderate temperature is compact and small. It allows a plurality of different types of operation, as described in the preceding, and can be controlled and regulated with a single microcomputer. The microcomputer control equipment 66 can have display elements 224 for the optical display of important operating data, and comprise several processors.

Figure 3A:
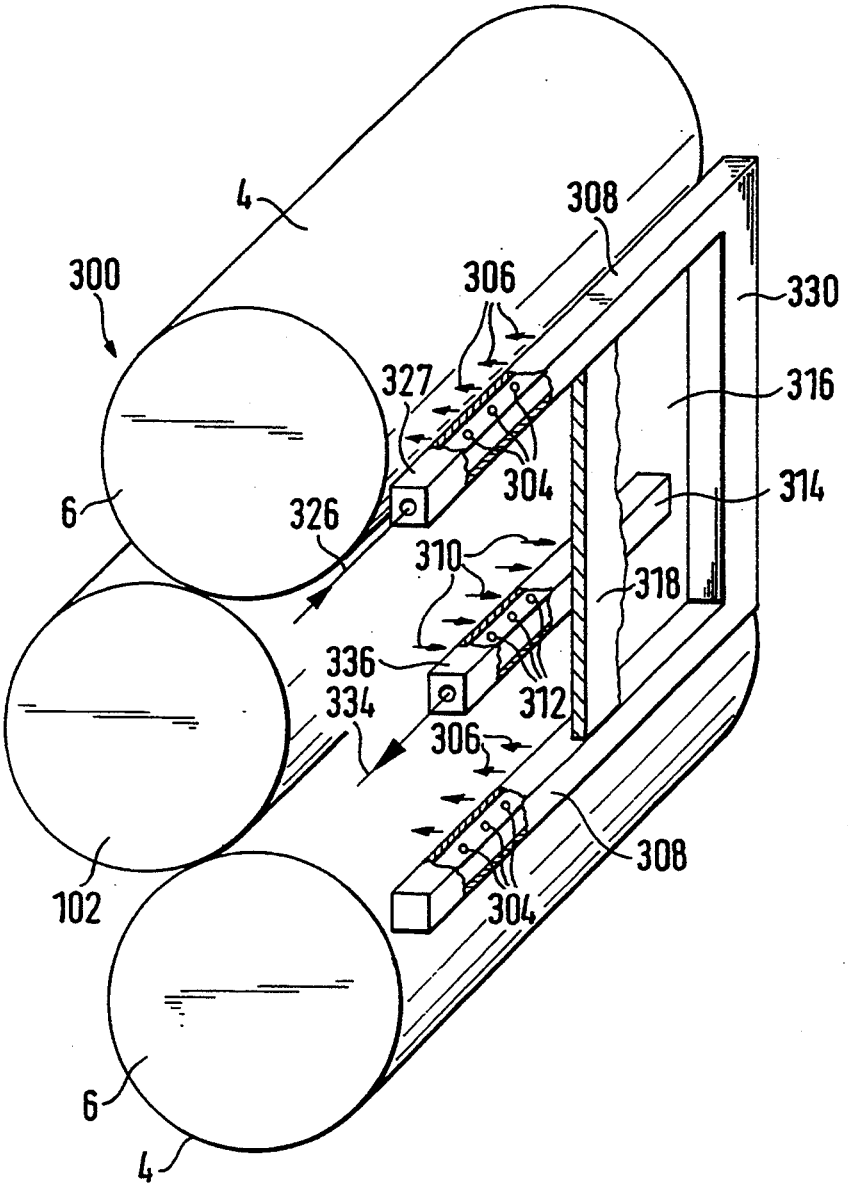
FIG. 3A and 3B shows a schematic representation of a further embodiment of an inventive system for keeping the printing plates at a moderate temperature, in which a blower and heat-exchanger unit is locally separated from blasting nozzles and suction nozzles, but is connected over fluid pipelines with these.
Figure 3B:
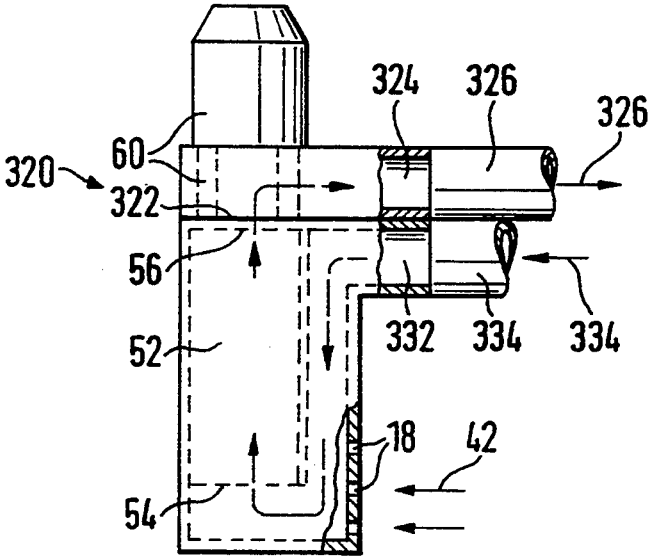

For the embodiment of FIGS. 3A and 3B, a printing unit 300 contains several rotating, cylindrical printing plates 6 and a blanket roller 102, which lies against them, for transferring the printed image from the printing plates 6 to a printing carder, which is to be printed.

The system for keeping the printing plates of this embodiment at a moderate temperature contains cold air outlets 304 in the form of a plurality of nozzles, which are directed against the cylindrical surfaces 4 of the printing plates 6 and blow cold air 306 onto these surfaces 4. The cold air nozzles 304 are formed in cold air ducts 308, preferably pipes, of which at least one extends over the surface 4 of each printing plate 6 parallel to the axis and at a small radial distance from the surface 4. The cold air 306, which is deflected from the surface 4 of the printing plates and which now is return air 310 heated by the printing plate 6, is aspirated through the return air inlets 312. The return air inlets 312 have the shape of a plurality of suction nozzles, which are formed in at least one return air duct 314, which preferably is a pipe. The air return pipe 314 is disposed in a space 316 formed by the cold air pipe 308, the printing plate 6 and the blanket roller 102. The space 316 preferably is essentially closed, for example, by a wall 318.

A blower and heat exchanger unit 320 is disposed locally separated from the cold air pipes 308 and the air return pipe 314. It contains at least one blower 60 and at least one*heat exchanger 52. The cold air outlet 56 of the heat exchanger 52 is in flow connection with the suction side 322 of the blower 60. The pressure side 324 of the blower 60 is connected over a fluid line 326, which is partially represented diagrammatically by arrows, with an inlet 327 of one of the cold air pipes 308 and supplies it with cold air cooled in the heat exchanger 52. A connection duct 330 distributes the cold air over all cold air pipes 308. Over a connection 332 and a second fluid line 334, which are partially shown diagrammatically by arrows, a heat exchanger air inlet 54 is connected to an outlet end 336 of the air return pipe 314, so that the blower 60 suctions off return air 310. At the same time, fresh air 42 can be taken in over boreholes 18 at the heat exchanger air inlet 54.

The blower and heat exchanger unit 320 can also be disposed locally separated from the cold air duct 308 and the air return duct 314, if only one of each of these ducts 308 and 314 is provided or if only one printing plate 6 is provided.

What is claimed is:

1. A system for keeping cylinders of a printing press at a moderate temperature, with blast-air cooling equipment, which comprises:

at least one heat exchanger, through which cooling liquid flows and which has a heat exchanger air inlet and a heat exchanger air outlet, and at least one blower, which drives air from the heat exchanger air inlet through the heat exchanger to the heat exchanger air outlet and from the heat exchanger air outlet as cold air onto a surface of a rotating cylinder of a printing press;

a first storage tank, from which cooling liquid is supplied one of alternatively and simultaneously to the heat exchanger of the blast-air cooling equipment as well as to the ink rollers of a color printing unit, which transfers printing ink from a ductor roller to a printing plate surface;

a cooling installation, in which for the removal of heat, cooling agent in a cooling agent cycle alternately is compressed from the gaseous state into a liquid state and subsequently expanded once again into the gaseous state; a cooling liquid cycle is also provided, the cooling liquid of which is pumped from a first pump out of the first storage tank through a heat exchanger of the cooling installation and then through the heat exchanger of the blast-air cooling equipment and subsequently flows back into the first storage tank; and a damping liquid cycle, the damping liquid of which is pumped by a second pump from a second storage tank through the heat exchanger apparatus of the same cooling installation and then into a damping liquid tub, from which a portion of the damping liquid is taken up by a roller rotating therein and is transferred to the surface of the rotating printing plate, and excess damping liquid is passed from the damping liquid tub back into the second storage tank.

2. The system for keeping cylinders at a moderate temperature of claim 1, characterized in that the first storage tank and the second storage tank each contain at least one liquid level sensor which generates a signal as a function of the liquid level.

3. The system for keeping cylinders at a moderate temperature of claim 1, characterized in that the heat exchanger equipment of the cooling installation has two heat exchangers, which are connected parallel to one another in the cooling agent cycle and the cooling agent flow of which is set and controlled independently of one another and, moreover, for each of these two heat exchangers as a function of its own desired temperature value, and that the one of these two heat exchangers serves for cooling the cooling liquid and the other for cooling the damping liquid.

4. The system for keeping cylinders at a moderate temperature of claim 3, characterized in that the damping liquid cycle has a by-pass line over which one of a portion and the whole of the damping liquid from the damping liquid outlet of the cooling installation is passed back into the second storage tank instead of to the damping liquid tub.

5. The system for keeping cylinders at a moderate temperature of claim 4, further comprising a microcomputer unit, which controls said blower and said pumps, and a display device connected to said microcomputer unit for the optical display of operating values.

* * * * *